United States Patent [19]

Walsh

[11] 4,298,824

[45] Nov. 3, 1981

[54] MILLIMETER AND SUB-MILLIMETER RADIATION SOURCE

[75] Inventor: John E. Walsh, Box 264, Bradford, Vt. 05033

[73] Assignees: Dartmouth College, Hanover, N.H.; John E. Walsh, ; a part interest

[21] Appl. No.: 104,737

[22] Filed: Dec. 18, 1979

[51] Int. Cl.[3] ..... H01J 25/00

[52] U.S. Cl. ..... 315/4; 315/3; 315/5

[58] Field of Search ..... 315/3, 4, 5

[56] References Cited

U.S. PATENT DOCUMENTS

| | | | |
|---|---|---|---|
| 2,869,023 | 1/1959 | Brewer | 315/3.6 |
| 3,072,817 | 1/1963 | Gordon | 315/3 |
| 3,178,656 | 4/1965 | Petroff | 315/3 X |
| 3,258,641 | 6/1966 | Petroff | 315/3 X |
| 3,259,786 | 7/1966 | Phillips | 315/3 |
| 3,348,093 | 10/1967 | Holly | 315/4 X |
| 3,789,257 | 1/1974 | Friedman et al. | 315/3 |
| 4,122,372 | 10/1978 | Walsh | 315/5 |
| 4,215,291 | 7/1980 | Friedman | 315/4 |

*Primary Examiner*—Saxfield Chatmon, Jr.
*Attorney, Agent, or Firm*—Cushman, Darby & Cushman

[57] ABSTRACT

A radiation source in which a beam of electrons is produced and directed along a path with dielectric material having a constant less than 4 in proximity to the path and an undulator providing oscillatory velocity modulation to the beam along the path for producing millimeter and sub-millimeter wavelength radiation.

6 Claims, 1 Drawing Figure

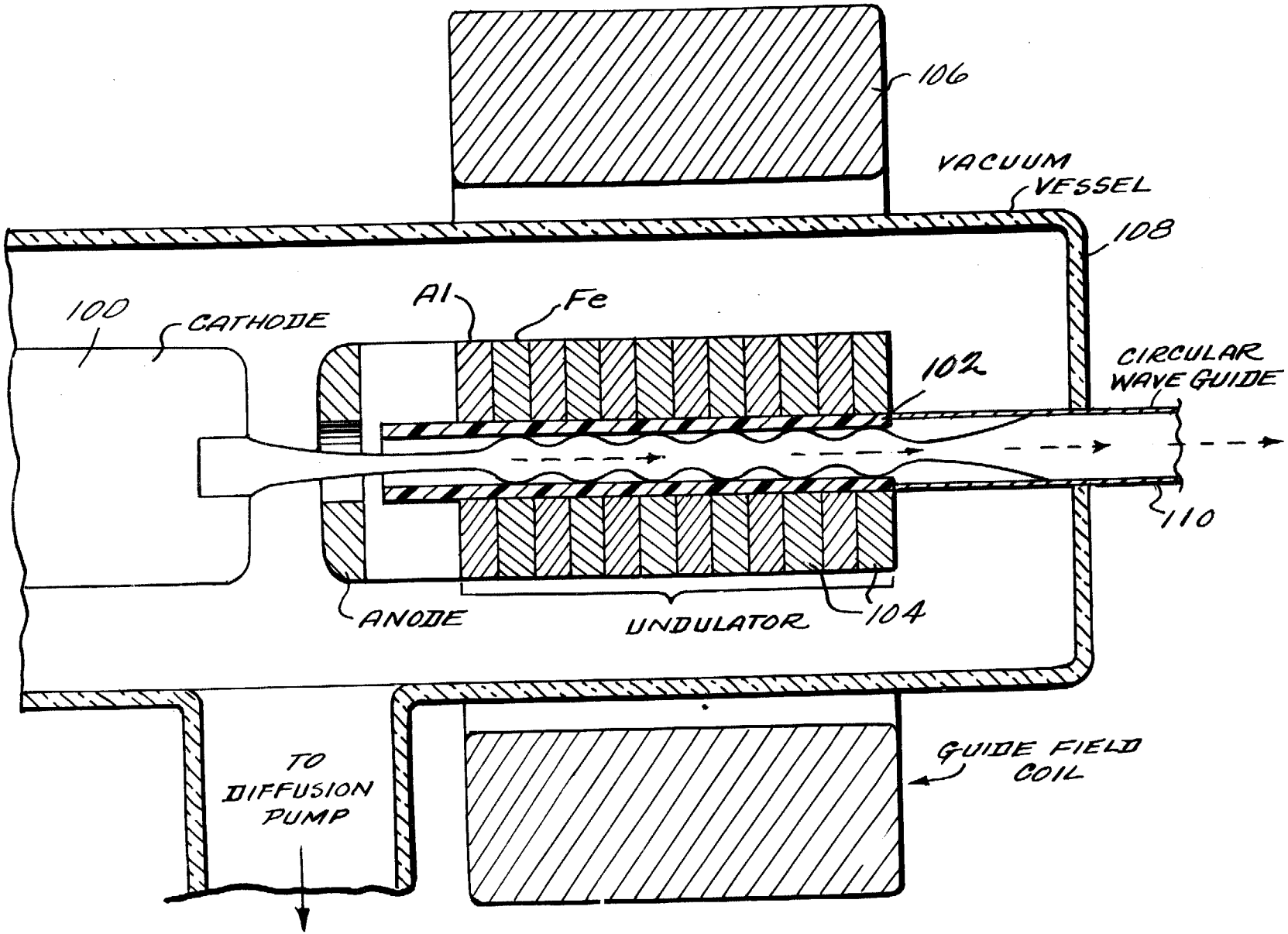
CIRCULAR WAVE GUIDE
110
108
VACUUM VESSEL
106
102
104
GUIDE FIELD COIL
UNDULATOR
Fe
Al
ANODE
CATHODE
100
TO DIFFUSION PUMP

MILLIMETER AND SUB-MILLIMETER RADIATION SOURCE

The present invention relates to a source for producing radiation, particularly radiation in the millimeter and sub-millimeter wavelengths.

As other parts of the electro-magnetic spectrum are filled, the need has arisen to utilize millimeter and sub-millimeter wavelengths for communication purposes. In addition, other technical applications exist where only such wavelengths can be used. Several devices have been proposed and developed for producing radiation at such wavelengths. For example, the patent to Walsh, U.S. Pat. No. 4,122,372, describes a method and apparatus for producing high power coherent microwave radiation. In this device, a beam of electrons is passed through a waveguide tube which includes a low dielectric constant material adjacent the path. The electromagnetic radiation is slowed in the material and the beam coupled to the radiation so that when the beam is focussed and guided the beam energy is converted into high power, high frequency, coherent microwave radiation.

An alternative approach to producing millimeter and sub-millimeter wavelength radiation is described in the patent to Phillips, U.S. Pat. No. 3,259,786. The type of device described in this patent is called a Ubitron, and produces a beam of electrons which is passed through a rippled or helical magnetic field and Doppler shifted. This rippled field can be produced by mounting pieces of iron, for example, rings, separated along the beam axis to provide transverse velocity modulation of the beam.

One drawback with the Ubitron is that, to achieve relatively short wavelength radiation, the speed of the electrons passing through the device must be relatively high. The frequency of Doppler shifted radiation produced by a Ubitron is determined by the following relation:

$$W_S = \frac{2\pi C\beta/\lambda_p}{1-\beta}$$

wherein:

$W_S$ is the frequency of radiation produced;

C is the speed of light;

$\lambda_p$ is the wavelength of the rippled field which is produced by disturbing a uniform axial field with iron pieces; and $\beta$ is the beam speed in percent of light speed.

From the above relation, it should be obvious that to reduce the wavelength of the radiation, the beam speed must be relatively close to 1, i.e., close to the speed of light. To produce such high beam speeds requires very high voltages applied to the cathode. For example, producing wavelengths of the order of one millimeter requires voltages of the order of one million volts. Such voltage sources are expensive, difficult to handle, and too large in size to be acceptable for many applications.

The present invention relates to an improved device in which dielectric material having a constant less than four is mounted in proximity to the beam path. When such dielectric material is provided, the frequency of Doppler shifted radiation produced is determined by the following relation:

$$W_S = \frac{2\pi\beta C/\lambda_p}{1-\beta/\beta_\phi}$$

The terms of this relation are the same as those noted above with the exception of $\beta_\phi$ the relative speed of the wave in the forward direction) which is determined by the frequency of emitted radiation and wave number K. The wave number K is in turn a function of the dielectric constant of the material, and its volume. Thus, by choosing a dielectric material having a low constant, for example, less than four, $\beta/\beta_\phi$ can be made relatively large without requiring high beam speeds. Thus, millimeter and sub-millimeter wavelength radiation can be produced at much lower beam speeds than in the Ubitron, and much lower voltages are required to produce those reduced beam speeds. Since as $\beta$ approaches 1, each increment of $\beta$ requires a much greater increment of energy input, the use of dielectric materials to reduce the beam speed required to produce a given desired wavelength results in very significant reductions in the energy required to produce the beam.

Many other objects and purposes of the invention will be clear from the following detailed description of the drawings.

BRIEF DESCRIPTION OF THE DRAWINGS

The FIGURE shows a schematic view of one embodiment of the present invention.

DETAILED DESCRIPTION OF THE DRAWINGS

Referring to the FIGURE, a beam of high speed electrons is produced by the conventional source 100 and passed along a path lined with dielectric material 102. An undulator 104 comprising a plurality of rings of iron separated by non-ferromagnetic material, for example, aluminum, is disposed along the beam path for providing transverse velocity modulation for the beam. Magnetic field coils 106 provide the uniform field which is modulated. Any suitable dielectric material can be used, preferably one having a dielectric constant less than four. Suitable materials include: quartz, polytetrafluoroethylene, polymethyl methacrylate, polyethylene, and polystyrene. The guide coils function to focus and guide the beam to keep stabilized the guided electro-magnetic modes and to convert the electron beam energy into high power coherent radiation. The cathode and undulator are preferably disposed within a conventional vacuum vessel 108. The electrons leaving the undulator can be collected in any conventional way, for example, by a circular waveguide 110.

Many changes and modifications in the above-described embodiment of the invention can be carried out without departing from the scope thereof. For example, the rings of iron need not be made as complete rings, but pieces of iron separated along the beam path can be utilized. For certain applications, it may be desirable to make $\beta/\beta_\phi$ greater than one, which, of course, is impossible with a Ubitron as described above. Such application would require high voltages but may offer other possibilities, for example, possibly higher gains. The illustrated embodiment makes use of electron beam modes known as space charge waves. Another possibility is to use a bundle of fibers with pieces of iron spaced along the bundle axis to operate a number of beams in parallel and thus increase total power at short wavelengths. The scope of the present invention is intended to be limited accordingly only by the scope of the following claims.

What is claimed is:

1. A radiation source comprising:

electron means for producing a beam of electrons and directing said beam along a linear path;

dielectric material having a dielectric constant less than 4 mounted in proximity to said path;

means for providing Ubitron type of interaction oscillatory velocity modulation to said beam along said path for providing millimeter and sub-millimeter wavelength radiation.

2. A source as in claim 1, wherein said material is formed as a cylindrical liner.

3. A source as in claim 1, wherein said providing means includes a plurality of soft iron pieces separated from each other by non-permeable material along the beam path to produce transverse modulation.

4. A source as in claim 1, 2, or 3, further including a vacuum vessel enclosing said dielectric material, providing means and electron means.

5. A source as in claim 1, 2, or 3 wherein said material is chosen from the group consisting essentially of quartz, polytetrafluoroethylene, polymethyl methacrylate, polyethylene, and polystyrene.

6. A source as in claim 1, 2, or 3 further including means for focussing and guiding said beam to destabilize the guided electro-magnetic modes, and to convert the electron beam energy into high power, coherent radiation.

* * * * *